US010916203B2

(12) United States Patent
Tsuge

(10) Patent No.: US 10,916,203 B2
(45) Date of Patent: Feb. 9, 2021

(54) DISPLAY APPARATUS

(71) Applicant: PANASONIC CORPORATION, Osaka (JP)

(72) Inventor: Hitoshi Tsuge, Osaka (JP)

(73) Assignee: JOLED INC, Tokyo (JP)

( * ) Notice: Subject to any disclaimer, the term of this patent is extended or adjusted under 35 U.S.C. 154(b) by 577 days.

(21) Appl. No.: 14/209,244

(22) Filed: Mar. 13, 2014

(65) Prior Publication Data

US 2014/0192101 A1 Jul. 10, 2014

Related U.S. Application Data

(63) Continuation of application No. PCT/JP2012/006543, filed on Oct. 12, 2012.

(30) Foreign Application Priority Data

Oct. 14, 2011 (JP) ..... 2011-226422

(51) Int. Cl.
*G09G 3/3291* (2016.01)
*G09G 3/3225* (2016.01)
*G09G 3/20* (2006.01)

(52) U.S. Cl.
CPC ..... *G09G 3/3291* (2013.01); *G09G 3/3225* (2013.01); *G09G 3/2081* (2013.01);
(Continued)

(58) Field of Classification Search
CPC combination set(s) only.
See application file for complete search history.

(56) References Cited

U.S. PATENT DOCUMENTS 5,454,076 A * 9/1995 Cain ..... G09G 5/393 345/531
8,614,652 B2 12/2013 Nathan et al.
(Continued)

FOREIGN PATENT DOCUMENTS

CN 102057418 A 5/2011
JP 2005-189695 A 7/2005
(Continued)

OTHER PUBLICATIONS

International Search Report issued in PCT/JP2012/006543, dated Dec. 4, 2012, with English translation.
(Continued)

*Primary Examiner* — William Boddie
*Assistant Examiner* — Alecia D English
(74) *Attorney, Agent, or Firm* — McDermott Will & Emery LLP

(57) ABSTRACT

A display apparatus has an image display unit having a plurality of arrayed pixel circuits, and an image signal compensation circuit compensating an image signal and outputs the compensated signal to the image display unit. Each of the pixel circuits has a compensating capacitor which compensates the threshold voltage of the driving transistor. The image signal compensation circuit has a compensation memory storing a compensation data for compensating the current variation of the driving transistors, a first comparison circuit which compares the image signal and first threshold value, and an arithmetic circuit compensating the image signal. When the image signal has a luminance larger than the threshold value, the compensation is performed.

6 Claims, 7 Drawing Sheets

(52) U.S. Cl.
CPC ..... *G09G 2300/0819* (2013.01); *G09G 2300/0852* (2013.01); *G09G 2300/0861* (2013.01); *G09G 2310/0251* (2013.01); *G09G 2310/0262* (2013.01); *G09G 2320/0233* (2013.01); *G09G 2320/0285* (2013.01); *G09G 2320/043* (2013.01); *G09G 2330/021* (2013.01); *G09G 2360/16* (2013.01)

(56) References Cited

U.S. PATENT DOCUMENTS

| | | | | |
|---|---|---|---|---|
| 2006/0022914 | A1* | 2/2006 | Kimura | G09G 3/2014 345/76 |
| 2007/0210996 | A1 | 9/2007 | Mizukoshi et al. | |
| 2009/0219308 | A1* | 9/2009 | Sagano | G09G 3/2081 345/690 |
| 2010/0039458 | A1 | 2/2010 | Nathan et al. | |
| 2010/0045652 | A1 | 2/2010 | Yamashita et al. | |
| 2010/0309187 | A1 | 12/2010 | Kang et al. | |
| 2011/0141149 | A1 | 6/2011 | Inoue et al. | |
| 2012/0274615 | A1* | 11/2012 | Ochi | G09G 3/3233 345/204 |
| 2014/0085359 | A1 | 3/2014 | Nathan et al. | |
| 2014/0361708 | A1 | 12/2014 | Nathan et al. | |

FOREIGN PATENT DOCUMENTS

| | | | |
|---|---|---|---|
| JP | 2005-284172 | A | 10/2005 |
| JP | 2009-169145 | A | 7/2009 |
| JP | 2010-134169 | A | 6/2010 |
| JP | 2010-282169 | A | 12/2010 |
| JP | 2011-081034 | A | 4/2011 |
| WO | 2009-008497 | A1 | 1/2009 |

OTHER PUBLICATIONS

Chinese Office Action and Search Report issued in corresponding Chinese Patent Application No. 201280049808.8 dated Jul. 1, 2015; 8 pages with English translation of the Search Report.

* cited by examiner

DISPLAY APPARATUS

RELATED APPLICATIONS

This application is a Continuation of International Application No. PCT/JP2012/006543, filed on Oct. 12, 2012, which claims priority to Japanese Application No. 2011-226422, filed on Oct. 14, 2011, the disclosures of which Applications are incorporated by reference herein.

TECHNICAL FIELD

The present disclosure relates to an active-matrix display apparatus employing a current light emitting device.

BACKGROUND

An organic EL (electroluminescence) display apparatus has a large number of arrayed self-luminous organic EL devices. The EL display apparatus does not require a backlight and does not have any viewing angle restrictions. Accordingly, it has been developed as a next generation display apparatus.

The organic EL device is a current light emitting device which can control luminance in response to an amount of current flow. Recently, an active-matrix organic EL display apparatus, which includes driving transistors for every pixel circuit, has been mainly used.

The driving transistor and the peripheral circuit are formed generally by TFT (Thin Film Transistors) made of poly-silicon or amorphous silicon. Although TFT has the disadvantage of a high threshold voltage fluctuation due to its low mobility, the TFT is suitable for a large-sized organic EL display apparatus because large sized TFT is easy to make and the cost of TFT is low.

A method for overcoming the above disadvantage (fluctuation of threshold voltage) has been studied by improving a pixel circuit. For example, Japanese Patent Application Publication JP2009-169145A1 describes an organic EL display apparatus which compensates the threshold voltage of the driving transistor.

Further, Japanese Patent Application Publication JP2010-134169A1 describes a display apparatus which can reduce luminance unevenness originated from the luminance variation between the pixels. This apparatus has a memory which stores information of luminance vs. voltage characteristic (i.e. gain and offset characteristic) for every pixel and compensation circuit which compensates an image signal based on the data stored in the memory.

Use of the organic EL device allows a display apparatus to consume a small amount of electronic power when dark images are displayed because the organic EL device is a current light emitting device. Especially, the display apparatus can be used for a long time only with battery when displaying a character on a black background. Thus, it is useful for portable, mobile or outdoor display apparatus.

According to the compensation circuit described in the JP2010-134169A1, the luminance unevenness may be reduced. However, power consumption of the display apparatus increases in order to operate the compensation circuit. Further, the compensation circuit operates irrespectively of the image to be displayed. Thus, the advantage of an organic EL device, i.e. low power consumption in displaying dark image, cannot be fully used.

SUMMARY

The present disclosure relates to a display apparatus having an image display unit and an image signal compensation circuit. The image display unit has a plurality of arrayed pixel circuits. Each of the pixel circuits has a current light emitting device and a driving transistor which supplies current to the current light emitting device.

The image signal compensation circuit compensates and outputs an image signal to the image display unit.

Each of the pixel circuits has a compensation capacitor which compensates a threshold voltage of the driving transistor.

The image signal compensation circuit has a compensation memory, a comparison circuit, and an arithmetic circuit. The compensation memory stores compensation data for compensating the current dispersion between the driving transistors. The comparison circuit compares the image signal with a predetermined threshold. The arithmetic circuit compensates the image signal.

When the image signal is larger than the threshold, the compensation is performed.

The foregoing structure allows displaying high quality images with less luminance unevenness with power consumption reduced in displaying dark images.

DETAILED DESCRIPTION

An embodiment of a display apparatus of the present disclosure will be described with reference to the accompanying drawings. Hereafter, as an example of the display apparatus, an active-matrix organic EL display apparatus that emits light from EL devices (which is an example of current light emitting devices) using a driving transistor is described. However, the present disclosure is not limited to the organic EL display apparatus. The present disclosure may be applicable to various active-matrix display apparatus employing arrayed pixel circuits, each having a current light emitting device that controls luminance in response to an amount of current flow and a driving transistor which supplies current to the current light emitting device.

First Embodiment

Figure 1:
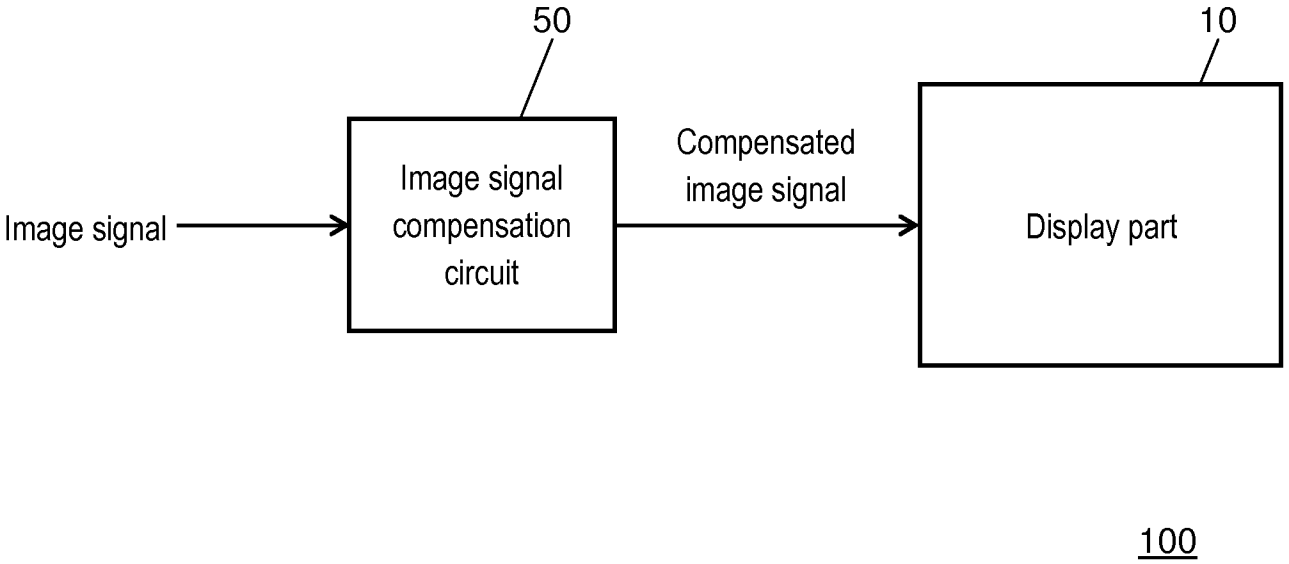
FIG. 1 is a block diagram illustrating a structure of the display apparatus according to a first embodiment.

FIG. 1 illustrates a structure of display apparatus 100 according to the first embodiment. Display apparatus 100 has image signal compensation circuit 50 compensating an inputted image signal and display image part 10 displaying the compensated image signal.

Display apparatus 100 drives an organic EL device (which is an example of a current light emitting device) using active matrix method. The luminance dispersion of display apparatus 100 mainly originates from dispersions of a threshold voltage between the driving transistors and a current between the driving transistors in each of the pixel circuits. In this embodiment, the current dispersion of the driving transistor is compensated by image signal compensation circuit 50, and the threshold voltage dispersion between the driving transistors are compensated by image display unit 10.

In other words, display device 100 according to this embodiment has image display unit 10 and image signal compensation circuit 50. Display unit 10 has multiple pixel circuits each having a current light emitting device and a driving transistor which supplies current to the current light emitting device. The circuit 50 compensates the image signal and outputs it to image display unit 10.

Figure 2:
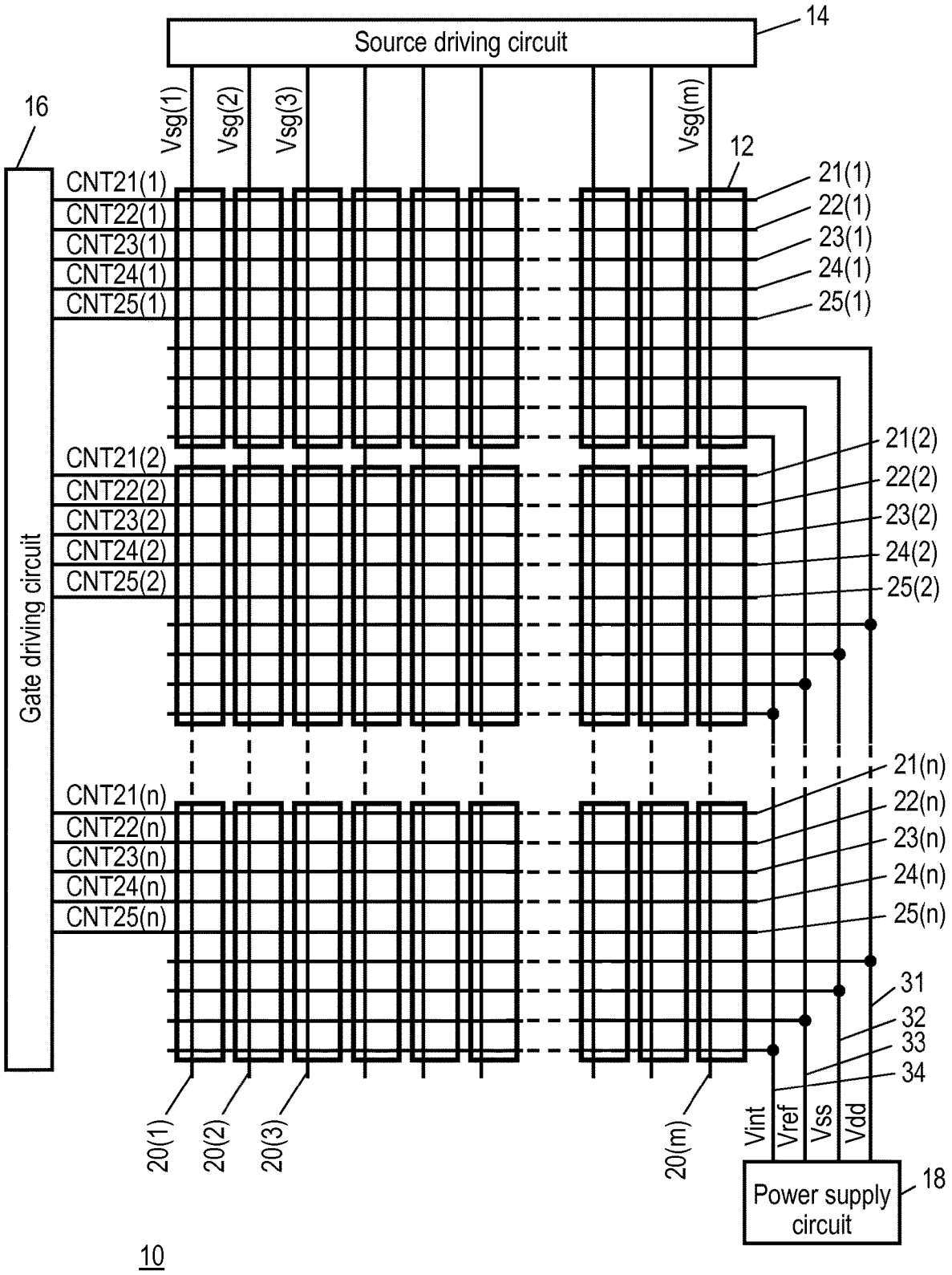
FIG. 2 is a block diagram illustrating a structure of an image display unit of the display apparatus.

FIG. 2 is a block diagram illustrating a structure of image display unit 10 of the display apparatus 100. Image display unit 10 has a plurality of pixel circuits 12 (*i, j*) (1<=i<=n, 1<=j<=m), source driving circuit 14, gate driving circuit 16, and power supply circuit 18. Multiple pixel circuits 12 (*i, j*) are arranged in matrix having n rows and m columns.

Source driving circuit 14 supplies an image signal voltage Vsg (j) (j represents each of the pixel columns 1 to m, m being the highest number) to each of data lines 20 (*j*). Pixel circuits 12 (1, *j*) to 12 (*n, j*), which are arranged in column (j) of the pixel circuit 12, are connected commonly to data line 20(*j*) as shown in FIG. 2.

Gate driving circuit 16 supplies control signals CNT21(*i*) to CNT25(*i*) (i represents each of the pixel rows 1 to n, n being the highest number) to each of the control signal lines 21(*i*) to 25(*i*). Pixel circuits 12 (*i*, 1) to 12 (*i, m*), which are arranged in the row (i) of the pixel circuit 12, are connected commonly to control signal lines 21(*i*) to 24(*i*) as shown in FIG. 2. In this embodiment, five kinds of control signals CNT21 (*i*) to CNT25 (*i*) are supplied to one pixel circuit 12 (*i, j*). However, the number of control signals is not limited to five.

Display image part 10 has power source lines 31 and 32, and voltage lines 33 and 34, which are connected commonly to all of the pixel circuits 12 (1, 1) to 12 (*n, m*). Power supply 18 supplies a high voltage Vdd to power source line 31 and supplies a low voltage Vss to power source line 32. These power sources are for emitting light from the organic EL devices described later. Power source circuit 18 also supplies reference voltage Vref to voltage line 33 and supplies initialization voltage Vint to voltage line 34.

Figure 3:
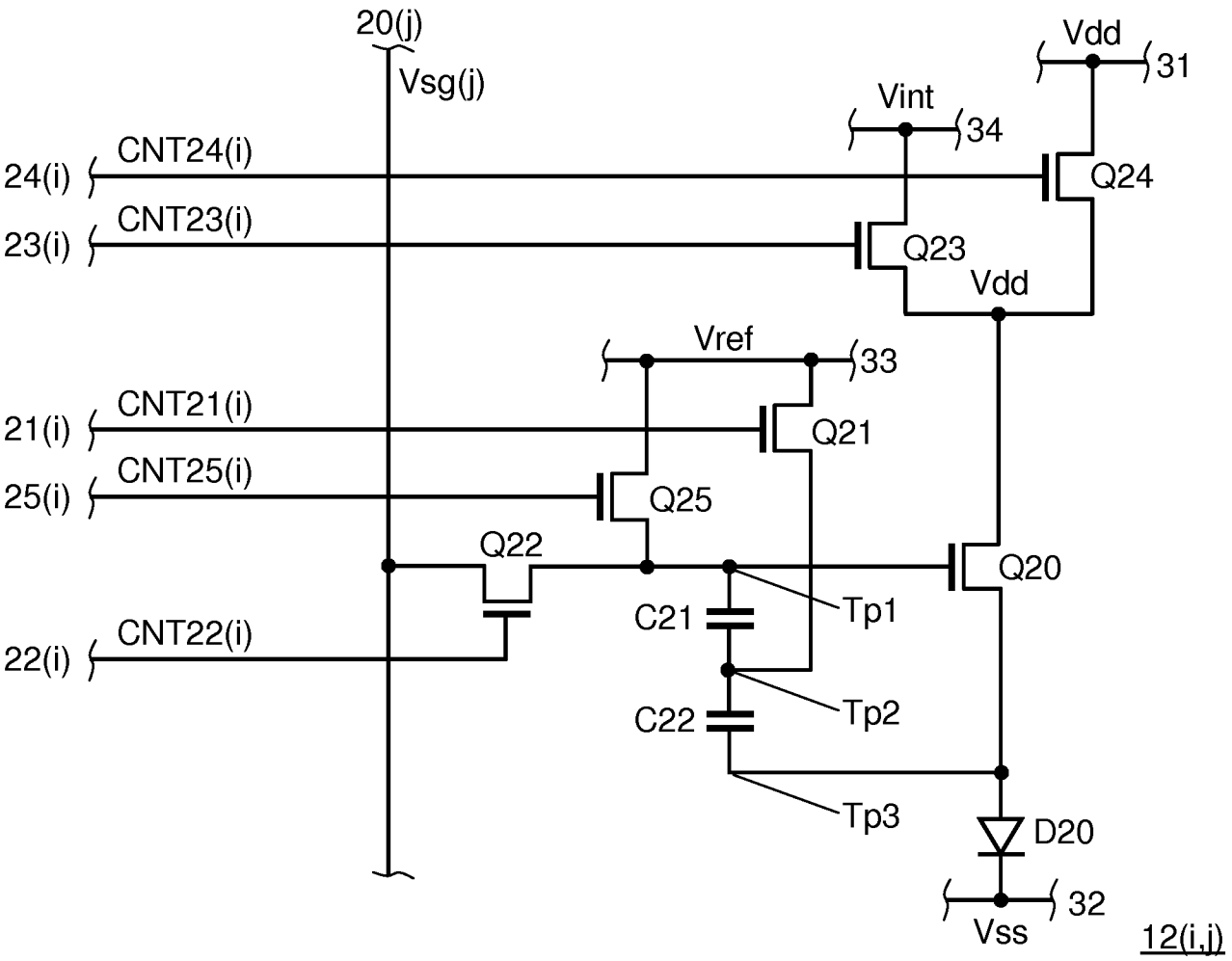
FIG. 3 is a circuit diagram of a pixel circuit of the image display unit.

FIG. 3 is a circuit diagram of a pixel circuit of image display unit 10 according to the first embodiment. Pixel circuit 12 (*i, j*) has organic EL device D20, driving transistor Q20, first capacitor C21, second capacitor C22, and transistors Q21 to Q25 which operate as switches.

Driving transistor Q20 supplies current to organic EL device D20. First capacitor C21 stores image signal voltage Vsg which varies in response to image signal (j). Transistor Q21 is a switch for applying reference voltage Vref to a terminal of first capacitor C21 and a terminal of second capacitor C22. Transistor Q22 is a switch for writing (charging) image signal voltage Vsg (j) to first capacitor C21. Transistor Q25 is a switch for applying reference voltage Vref to a gate of driving transistor Q20. Second capacitor C22 stores threshold voltage Vth of driving transistor Q20. Transistor Q23 is a switch for applying initialization voltage Vint to a drain of driving transistor Q20. Transistor Q24 is a switch for supplying high voltage Vdd to the drain of driving transistor Q20.

In this embodiment, all of driving transistor Q20 and transistors Q21 to Q25 are N-channel TFT and enhancement type transistors. However, other type of transistors can be used.

Pixel circuit 12 (*i, j*) according to this embodiment has a structure that transistor Q24, driving transistor Q20 and organic EL device D20 are connected together in series between power source lines 31 and 32. In other words, a drain of transistor Q24 is connected to power source line 31. A source of transistor Q24 is connected to the drain of driving transistor Q20. A source of driving transistor Q20 is connected to an anode of the device D20. A cathode of organic EL device D20 is connected to power source line 32.

First capacitor C21 and second capacitor C22 are connected in series between a gate and source of driving transistors Q20. That is, one terminal (first terminal) of first capacitor C21 is connected to the gate of driving transistor Q20. Second capacitor C22 is connected between another terminal (second terminal) of first capacitor C21 and the source of driving transistor Q20. Hereafter, a node to which the gate of driving transistor Q20 and first capacitor C21 are connected is called "node Tp1". A node to which the capacitors C21 and C22 are connected is called "node Tp2". A node to which second capacitor C22 and the source of driving transistor Q20 are connected is called "node Tp3".

A drain of transistor Q21 (first switch) is connected to voltage line 33 which supplies reference voltage Vref. A source of transistor Q21 is connected to node Tp2. A gate of transistor Q21 is connected to control signal line 21(*i*). Transistor Q21 thereby applies reference voltage Vref to node Tp2. When transistor Q21 is a P-channel TFT, the position of gate and source are reverse to that of an N-channel TFT. The same structure can be applied to the transistors (Q22, Q23, Q24, Q25) described below.

A drain of transistor Q22 (second switch) is connected to node Tp1. A source of transistor Q22 is connected to data line 20(*j*) which supplies image signal voltage Vsg. A gate of transistor Q22 is connected to control signal line 22(*i*). Transistor Q22 thus supplies image signal voltage Vsg to the gate of driving transistor Q20.

A drain of transistor Q25 (fifth switch) is connected to voltage line 33 that supplies reference voltage Vref. A source of transistor Q25 is connected to node Tp1. A gate of transistor Q25 is connected to control signal line 25(*i*). Transistor Q25 thus supplies reference voltage Vref to the gate of driving transistor Q20.

A drain of transistor Q23 (third switch) is connected to a drain of driving transistor Q20. A source of transistor Q23 is connected to voltage line 34 that supplies initialization voltage Vint. A gate of transistor Q23 is connected to control signal line 23(*i*). The transistor Q23 thus supplies initialization voltage Vint to the drain of driving transistor Q20.

A drain of transistor Q24 is connected to power source line 31. A source of transistor Q24 is connected to the drain of driving transistor Q20. A gate of transistor Q24 is connected to control signal line 24(*i*). Transistor Q24 thus supplies current to the drain of driving transistor Q20 for emitting light from organic EL device D20.

Control signals CNT21(*i*) to CNT25(*i*) are supplied respectively to control signal lines 21(*i*) to 25(*i*).

As described above, pixel circuit 12 (*i, j*) according to this embodiment has first capacitor C21 having a first terminal connected to a gate of driving transistor Q20;

second capacitor C22 connected between a second terminal of first capacitor C21 and a source of driving transistor Q20;

transistor Q21 (first switch) applying reference voltage Vref to node Tp2 of the capacitors C21 and C22;

transistor Q22 (second switch) supplying image signal voltage Vsg to the gate of driving transistor Q20;

transistor Q25 (fifth switch) applying reference voltage Vref to the gate of driving transistor Q20;

transistor Q23 (third switch) supplying initialization voltage Vint to a drain of driving transistor Q20, and transistor Q24 (fourth switch) supplying a current to the drain of driving transistor Q20 for emitting light from organic EL device D20.

In this embodiment, the minimum voltage between the anode and cathode of the organic EL device D20 is 1 (V) (this minimum voltage is called Vled) when a current flows in the device D20. The capacity between the anode and cathode of organic EL device D20 is 1 (pF) when a current does not flow in the device D20. Threshold voltage Vth of driving transistor Q20 is about 1.5(V). The electric capacity of first capacitor C21 and second capacitor C22 is 0.5 (pF). Regarding the driving voltage, high-voltage Vdd is 10(V) and low-voltage Vss is 0(V). The setting of reference voltage Vref and initialization voltage Vint will be detailed later; however, they are set so as to meet two conditions described below.

$$Vref - V\,int > Vth \quad \text{(Condition 1)}$$

$$Vref < Vss + Vled + Vth \quad \text{(Condition 2)}$$

In this embodiment, reference voltage Vref is 1(V), and initialization voltage Vint is −1(V). However, these values can be changed according to the specification of the display apparatus or characteristic of each of the devices. Thus, the driving voltage can be optimally set according to the specification of the display apparatus or characteristic of the devices and within the range of the above conditions.

Figure 4:
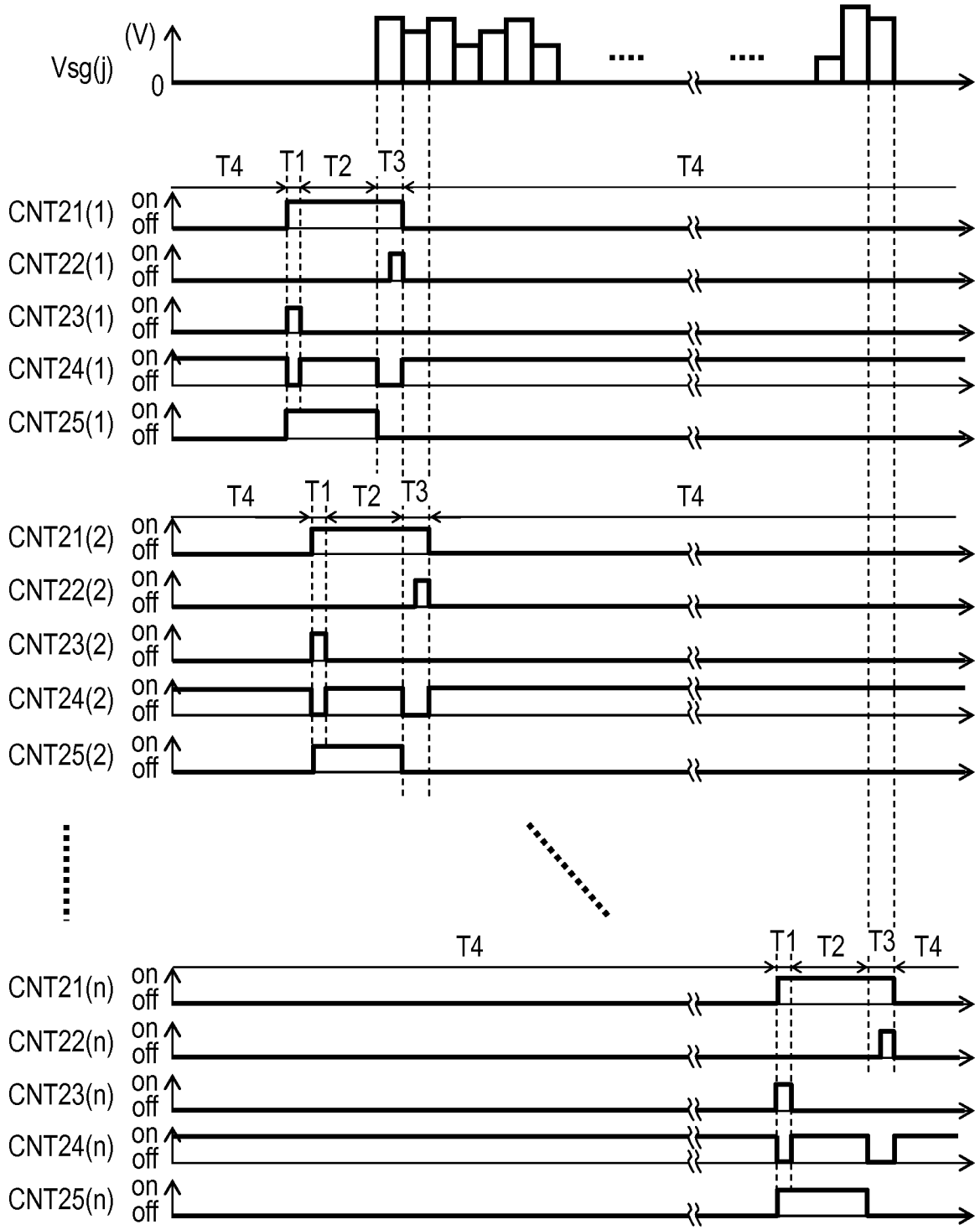
FIG. 4 is a timing diagram illustrating an operation of the image display unit.

Next, an operation of the pixel circuit 12 (*i, j*) is described. FIG. 4 is a timing diagram illustrating an operation of display unit 10 according to the first embodiment.

As shown in FIG. 4, one frame period is divided into four periods (i.e. initialization period T1, threshold detecting period T2, writing period T3, and luminescence period T4) in order to control organic EL devices D20 in each of the pixel circuits 12 (*i,j*).

In initialization period T1, second capacitor C22 is charged to a predetermined voltage.

In threshold detecting period T2, threshold voltage Vth of driving transistor Q20 is detected.

In writing period T3, image signal voltage Vsg (j) corresponding to the image signal is written (charged) to first capacitor C21.

In luminescence period T4, a sum of terminal to terminal voltages first capacitor C21 and terminal to terminal voltage of second capacitor C22 is applied between the gate and source of driving transistor Q20 in order to supply the current to organic EL device D20 and to emit light from the device D20.

Hereafter, the terminal to terminal voltage of first capacitor C21 is referred to as voltage V21, and the terminal to terminal voltage of second capacitor C22 is referred to as voltage V22.

The timing of these four periods are set so that the pixel circuits belonging in the same row (i), (i.e. pixel circuits 12 (*i*, 1) to 12 (*i, m*)) operates with substantially same timings. Meanwhile, the timings of writing period T3 are set so that the period T3 in the different rows does not overlap each other. Accordingly, while a writing operation is being performed on one pixel row, the other pixel rows can execute an operation other than the writing. Thus, driving period can be used efficiently.

Figure 5:
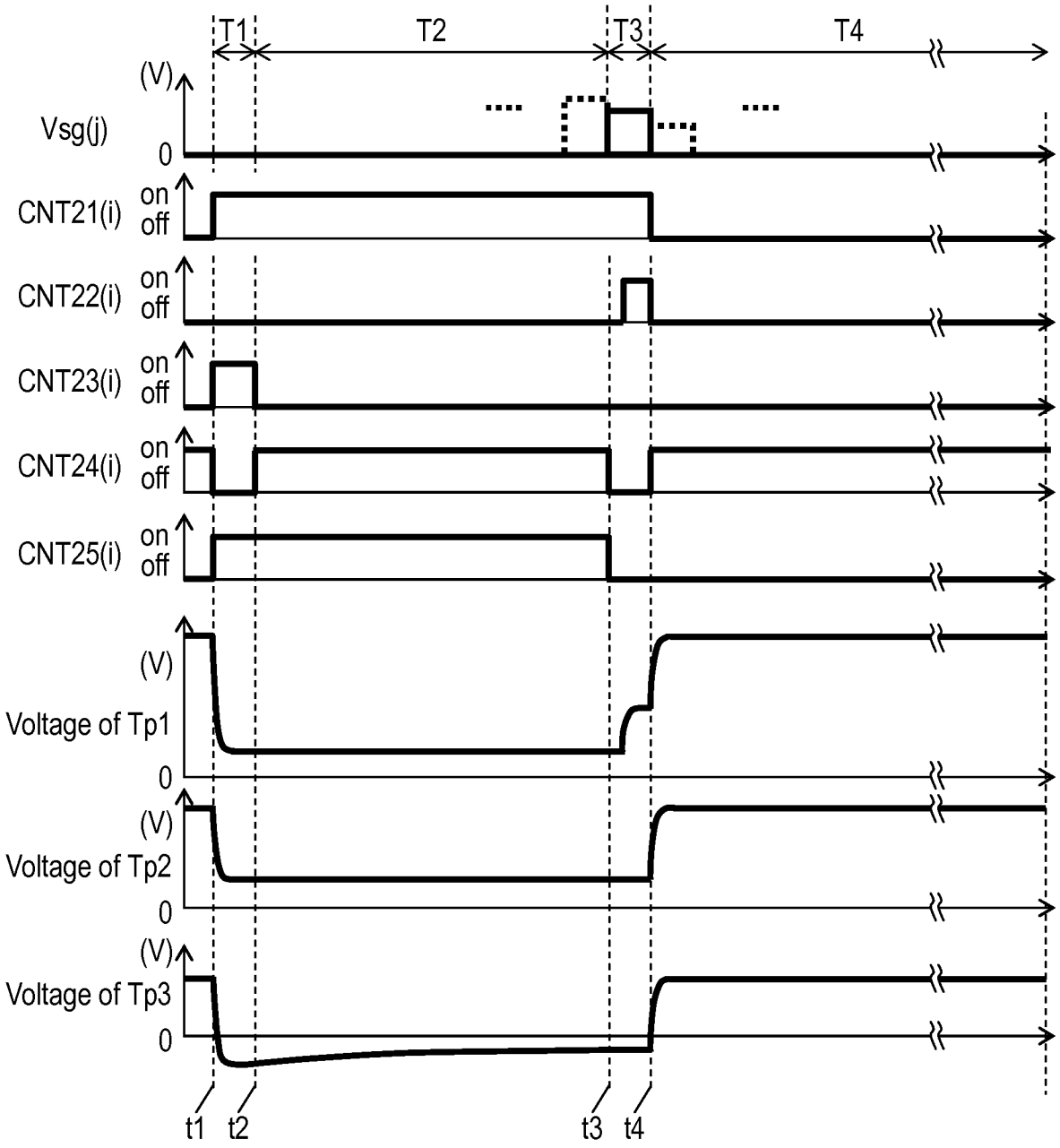
FIG. 5 is a timing diagram illustrating an operation of the pixel circuit of the image display unit.

FIG. 5 is a timing diagram illustrating an operation of the pixel circuit 12 (*i, j*) of the display unit 10 according to the first embodiment. In FIG. 5, changes in voltages at nodes Tp1 to Tp3 are also shown. The operation of pixel circuit 12 (*i, j*) is detailed hereafter for each of the divided periods.

Initialization Period T1

At time t1, while control signals CNT22(*i*) and CNT 24(*i*) are set to low level to set transistors Q22 and Q24 OFF, control signals CNT21(*i*), CNT23(*i*), and CNT25 (*i*) are set to high level to set transistors Q21, Q23, and Q25 ON. Reference voltage Vref is thereby applied to node Tp1 via transistor Q25 and to node Tp2 via transistor Q21.

Initialization voltage Vint is applied to the drain of driving transistor Q20 via transistor Q23. As derived from the condition 1, initialization voltage Vint is set lower than the voltage (Vref-Vth). Thus, a source voltage of driving transistor Q20, (i.e. voltage of node Tp3) turns to initialization voltage Vint. The voltage (Vref-Vint), which is higher than threshold voltage Vth, is thereby charged between the terminals of second capacitor C22.

Initialization voltage Vint is set to a voltage lower than a sum of low-voltage Vss and voltage Vled as derived from the conditions 1 and 2. That is, Vint<Vss+Vled. Accordingly, organic EL device D20 does not emit light because the current does not flow in the device D20.

In this embodiment, initialization period T1 is set to 1 micro second.

Threshold Detection Period T2

At time t2, control signal CNT23(*i*) is set to low level to set transistor Q23 OFF, and control signal CNT24(*i*) is set to high level to set transistor Q24 ON. At this point, the current flows in driving transistor Q20 because voltage V22, which is larger than threshold voltage Vth of driving transistor Q20, is applied between the gate and source of driving transistor Q20.

However, the current does not flow in the organic EL device D20 because the voltage of the anode of the device D20 is lower than the voltage (Vref−Vth) (i.e. Vref−Vth<Vss+Vled as derived from the condition 2. Due to the current flowing in driving transistor Q20, second capacitor C22 is discharged and voltage V22 starts decreasing. However, the current keeps flowing in driving transistor Q20, although the amount of the current continues to decrease, because voltage V22 is still higher than threshold voltage Vth. When voltage V22 decreases to voltage Vth, the current stops flowing in driving transistor Q20, and voltage V22 also stops decreasing.

As described above, second capacitor C22 is a compensating capacitor which compensates threshold voltage Vth of the corresponding driving transistor Q20.

The current flowing in driving transistor Q20 decreases as voltage V22 decreases because driving transistor Q20 operates as a current source which is controlled by the voltage between the gate and source of driving transistor Q20. As a result, a long time is required before voltage V22 falls to threshold voltage Vth. Moreover, long time requirement is further caused because the large electric capacity of organic EL device D20 is added to the electric capacity of second capacitor C22. Practically, this takes 10 to 100 times longer than the case of discharging the capacitor by transistor-switching. For this reason, threshold detection period T2 is set to 10 micro seconds in this embodiment.

Writing Period T3

At time t3, control signal CNT25(*i*) is set to low level to set transistor Q25 OFF, and control signal CNT24(*i*) is set to low level to set transistor Q24 OFF. Control signal CNT22(*i*) is then set to high level to set transistor Q22 ON. As a result, the voltage of node Tp1 turns to image signal voltage Vsg (j), and voltage (Vsg−Vref) is charged between the terminals of first capacitor C21. Hereafter, this voltage (Vsg−Vref) is indicated as image signal voltage Vsg'.

At this time, voltage V22 does not change because the current does not flow in driving transistor Q20.

In this embodiment, writing period T3 is set to 1 micro second.

Luminescence Period T4

At time t4, control signal CNT22(*i*) is set to low level to set transistor Q22 OFF, and control signal CNT21(*i*) is set to low level to set transistor Q21 OFF. Consequently, nodes Tp1 to Tp3 temporarily enter a floating state.

Then, control signal CNT24(*i*) is set to high level to set transistor Q24 ON. As a result, the current corresponding to a voltage between the gate and source of driving transistor Q20 is supplied to the organic EL device D20 because the source voltage of the transistor Q20 increases because the voltage (Vsg'+Vth), which is higher than threshold voltage Vth, is applied between the gate and source of driving transistor Q20. At this point, the current (I) satisfies;

$$I=\mu*k*(VGS-Vth)\hat{}2=\mu*k*Vsg'\hat{}2,\text{where,}$$

VGS: voltage between a gate and source of driving transistor Q20,

μ: mobility of driving transistor Q20, $$k=C-W/2L,\text{where}$$

C: gate insulating capacitance,

L: channel length, and

W: channel width of the driving transistor.

This equation is free from threshold voltage Vth.

As discussed above, current flowing in organic EL device D20 is not influenced by threshold voltage Vth. Therefore, the current flowing in the device D20 is free from being affected by dispersion of threshold voltage Vth of driving transistor Q20. Display unit 10 according to this embodiment can thereby reduce the luminance unevenness in an area displaying dark image having low luminance that is originated from the dispersion of threshold voltages Vth among driving transistors Q20.

However, the luminance unevenness may occur in an area displaying bright image having high luminance because the current of driving transistor Q20 varies due to dispersion of mobility μ among driving transistors Q20. Thus, in this embodiment, dispersion of mobility μ among driving transistors Q20 is using image signal compensation circuit 50.

Figure 6:
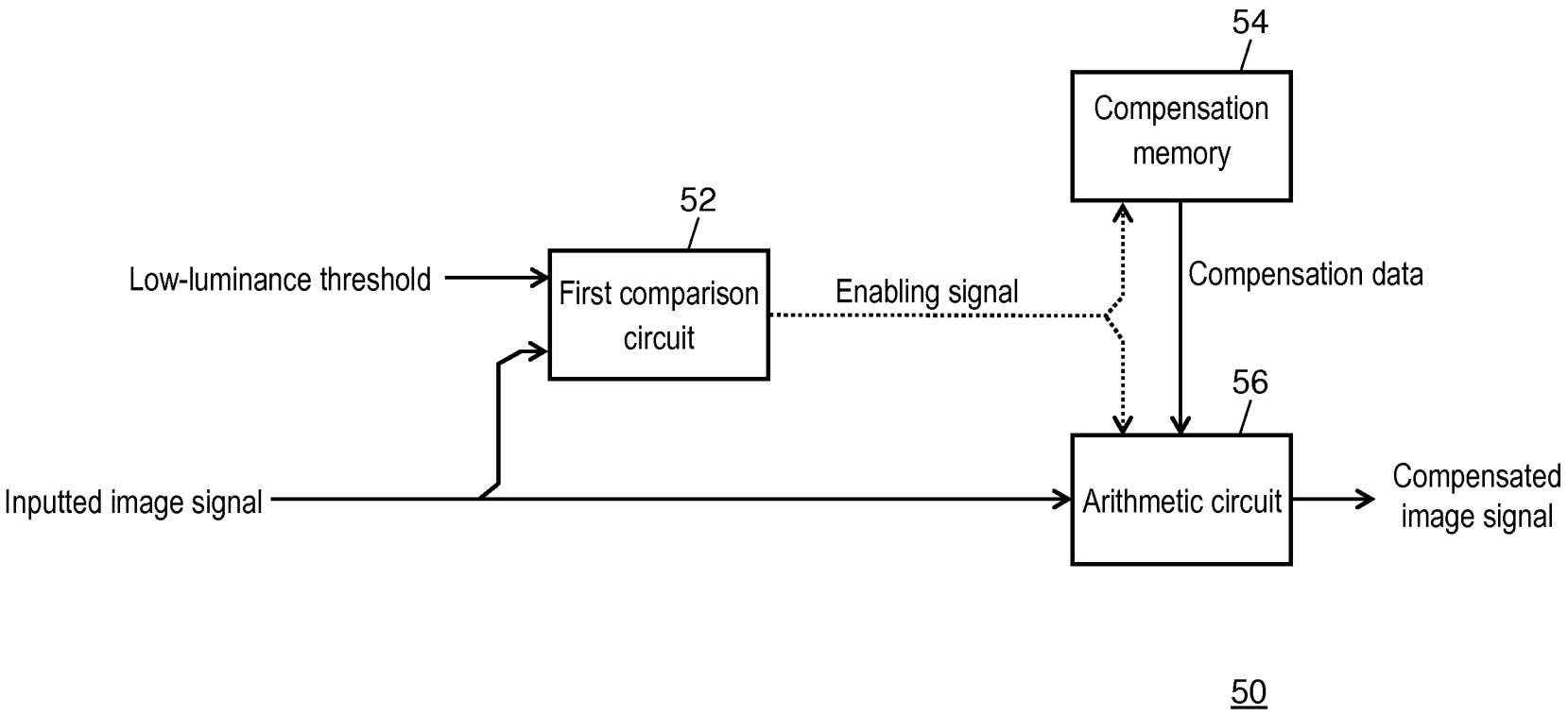
FIG. 6 is a block diagram of the image signal compensation circuit of the display apparatus.

FIG. 6 is a block diagram of image signal compensation circuit 50 of display apparatus 100 in the first embodiment. Image signal compensation circuit 50 has first comparison circuit 52, compensation memory 54, and arithmetic circuit 56.

First comparison circuit 52 compares the inputted image signal with the first threshold (it is referred to as "low-luminance threshold" hereafter). When the luminance of the image signal is larger than the low-luminance threshold, an enabling signal is outputted to compensation memory 54 and arithmetic circuit 56.

Compensation memory 54 is configured by a frame memory and stores compensation data for every pixel of image display unit 10. When an enabling signal is "High", the compensation data is outputted to arithmetic circuit 56.

When the enabling signal is "High", arithmetic circuit 56 multiplies the inputted image signal by the compensation data and outputs the result to image display unit 10 as a compensation image signal. When the enabling signal is "Low", the image signal is outputted directly to image display unit 10 as a compensation image signal. Image display unit 10 then displays an image based on the compensated image signal outputted from arithmetic circuit 56.

The compensation data according to this embodiment can be set as follows.

First, image signal Vo, which has a predetermined voltage, is inputted to image display unit 10 so that organic EL devices D20 can emit light such that the whole screen becomes relatively highly luminescent. Then, current Ix, which flows into driving transistor Q20*x* of pixel x of image display unit 10, is measured for every pixel. When the measurement of the current is difficult, luminance for every pixel can be measured instead, and the current for every pixel can be estimated based on the current vs. luminance characteristic of the organic EL device.

As described above, since the dispersion of threshold voltage Vth among driving transistors Q20 is cancelled by pixel circuit 12 of image display unit 10, current 1*x*, which flows in driving transistor Q20*x* of pixel x, meets $$Ix=\mu x*k*Vo\hat{}2,\text{where}$$

μx: mobility of driving transistor Q20*x*.

In reference pixel o which does not require a compensation of an image signal, reference current Io, which flows in driving transistor Q20*o*, meets $$Io=\mu o*k*Vo\hat{}2,\text{where}$$

μo: mobility of driving transistor Q20*o*.

Next, Ix/Io (ratio of current Ix in pixel x to reference current Io) is calculated. Square root of the reciprocal of this ratio is then calculated as compensation data Gx for pixel x. That is, $$Gx=(Io/Ix)\hat{}(1/2)=(\mu o/\mu x)\hat{}(1/2).$$

Compensation data Gx, which is calculated as above for every pixel, is stored to compensation memory 54.

By setting compensation data Gx as above, luminance unevenness can be reduced in an area displaying high luminance image. This is detailed hereafter.

If image signal V that is larger than the low-luminance threshold is inputted, the enabling signal which is outputted from first comparison circuit 52 is set to "High". Compensation memory 54 then outputs the compensation data Gx to pixel x. Arithmetic circuit 56 multiplies image signal V by compensation data Gx and outputs compensation image signal Gx*V. As a result, current 1*x*, which flows in driving transistor Q20*x* of pixel x of image display unit 10, meets the following equation.

$$Ix=\mu x*k*(Gx*V)\hat{}2=\mu o*k*V\hat{}2$$

Thus, Ix becomes equal to reference current Io.

By compensating the image signal as above, the current dispersion among drive transistors Q20 is reduced even when mobility μ has dispersion among driving transistors Q20. The luminance unevenness, originated from the mobility dispersion, is reduced in an area displaying bright image having high luminance.

Furthermore, according to this embodiment, when a dark image signal, having a luminance smaller than the low-luminance threshold, is inputted, the enabling signal outputted from first comparison circuit 52 is set to "Low". As a result, compensation memory 54 is not accessed and arithmetic circuit 56 does not operate. Thus, power consumption of image signal compensation circuit 50 becomes very small. For this reason, image signal compensation circuit 50 does not compensate the image in the low luminance area. However, the quality of the image does not deteriorate because the luminance unevenness, which is originated from the dispersion of threshold voltage Vth of driving transistors Q20, is reduced by image display unit 10.

As discussed above, image signal compensation circuit 50 has compensation memory 54 which stores a compensation data for compensating the current dispersion among driving transistors Q20, first comparison circuit 52 which compares an image signal with the low-luminance threshold (first threshold), and arithmetic circuit 56 which compensates the image signal. When the image signal is larger than the first threshold, the image signal is compensated.

According to this embodiment, arithmetic circuit 56 is configured by a multiplier. Instead, the circuit 56 can be configured in another way as far as it can compensate the dispersion of current-flow between driving transistors Q20. For example, arithmetic circuit 56 can be configured using adder. In this case, the compensation data may be outputted from the compensation memory for every gray scale level in every pixel. This configuration is achieved by using a driving transistor having a predetermined current characteristic. However, the compensation memory needs large memory capacity corresponding to the number of the pixels multiplied by the steps of gray scale levels.

Further, according to this embodiment, image signal compensation circuit 50 does not compensate the image signal when the image signal is smaller than the low-luminance threshold, and compensates the image signal when the image signal is larger than the low-luminance threshold. However, when displaying characters on a black background, luminance unevenness is not recognized easily even when the luminance is high. In such case, compensation does not have to be performed even on high luminance area in order to reduce power consumption. This is detailed in the second embodiment.

Second Embodiment

Figure 7:
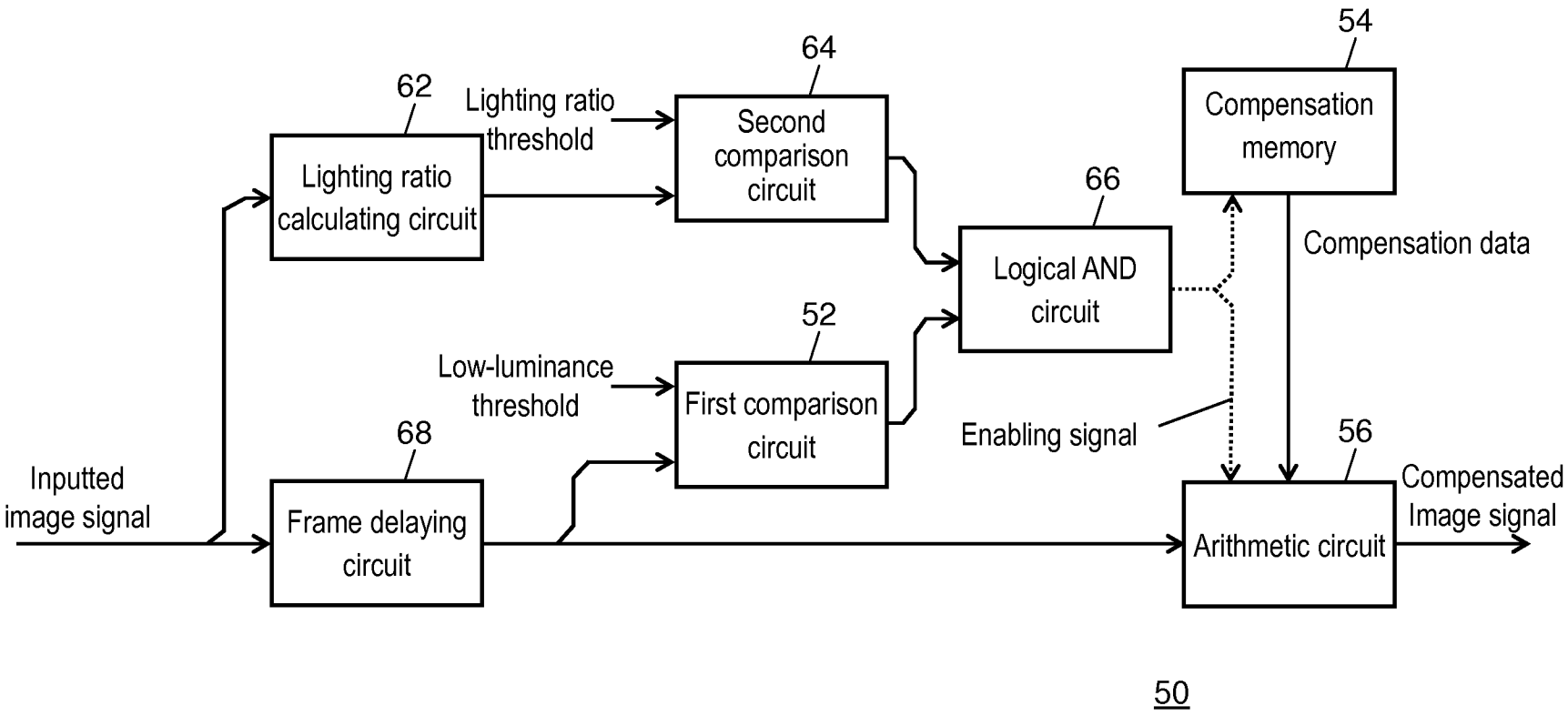
FIG. 7 is a block diagram of the image signal compensation circuit according to a second embodiment.

FIG. 7 is a block diagram of image signal compensation circuit 50 of display apparatus 100 according to the second embodiment. Image signal compensation circuit 50 has first comparison circuit 52, compensation memory 54, arithmetic circuit 56, lighting ratio calculating circuit 62, second comparison circuit 64, logical AND circuit 66, and one-frame delaying circuit 68.

Lighting ratio calculating circuit 62 calculates the lighting ratio of a frame based on the image signal in one frame period. Here, the lighting ratio is the ratio of the number of light emitting pixels to the total number of the pixels. The light emitting pixel refers to all the pixels except for the pixels which do not emit light at all, and also refers to the pixels ranging from a slightly lighting pixel to a brightly lighting pixel. However, a pixel having luminosity smaller than a predetermined value, which corresponds to a very dark signal, may be excluded from the above referred light emitting pixel. In other words, the lighting ratio can be determined based on the number of the pixels having luminosity larger than the predetermined value.

Second comparison circuit 64 compares the lighting ratio for every frames and the second threshold (this is referred to as "lighting ratio threshold" hereafter). When the lighting ratio is larger than the lighting ratio threshold, the second enabling signal is outputted to logical AND circuit 66.

One-frame delaying circuit 68 delays the inputted image signal by one frame. This circuit is provided in order to make the phases of the signals from first comparison circuit 52 and second comparison circuit 64 equal, because a delay corresponding to one frame period occurs during the calculation in the lighting ratio calculation circuit 62.

First comparison circuit 52 compares the delayed image signal and the low-luminance threshold. When the image signal is larger than the low-luminance threshold, the circuit 52 outputs the first enabling signal to logical AND circuit 66.

Logical AND circuit 66 calculates the logical AND of the first enabling signal outputted from first comparison circuit 52 and the second enabling signal outputted from second comparison circuit 64. Then the circuit 66 outputs the calculated result to compensation memory 54 and arithmetic circuit 56 as an enabling signal.

Similarly to compensation memory 54 of the first embodiment, compensation memory 54 stores compensation data for every pixels of image display unit 10. When an enabling signal is "High", the compensation data is outputted to arithmetic circuit 56.

Similarly to arithmetic circuit 56 of the first embodiment, arithmetic circuit 56 multiplies the compensated data by the inputted image signal. Arithmetic circuit 56 then outputs the multiplied result as a compensated image signal when the enabling signal is "High". When the enabling signal is "Low", the circuit 56 outputs the image signal without performing the multiplication.

Next, an operation of image signal compensation circuit 50 according to this embodiment is described.

First, lighting ratio calculation circuit 62 calculates the lighting ratio in one frame based on the image signal of the frame. When the image signal of the frame has a lighting ratio which is larger than the lighting ratio threshold, second comparison circuit 64 outputs the second enabling signal of "High" status.

In this case, image signal compensation circuit 50 operates similarly to the circuit 50 of the first embodiment. That is, in the area having image signal larger than the low-threshold, first comparison circuit 52 outputs a first enabling signal of "High" status, and the logical AND circuit 56 outputs an enabling signal of "High" status. Compensation memory 54 then outputs the compensation data Gx of the pixel x. Arithmetic circuit 56 further multiplies image signal V by compensation data Gx and outputs compensation image signal Gx*V. Luminance unevenness of the bright image displaying area having high luminance is thereby reduced by compensating the data.

When a dark image signal, which is smaller than the low-luminance threshold, is inputted, first comparison circuit 52 outputs an enabling signal of "Low" status. As a result, compensation memory 54 is not accessed and arithmetic circuit 56 does not operate. Power consumption of image signal compensation circuit 50 thus becomes very small.

When the image signal of the frame has a lighting ratio smaller than the lighting ratio threshold, second comparison circuit 64 outputs a second enabling signal of "Low" status. Logical AND circuit 66 thus outputs an enabling signal of "Low" status irrespective of the status of the first enabling signal. Accordingly, compensation memory 54 is not accessed and arithmetic circuit 56 does not operate, and power consumption of image signal compensation circuit 50 becomes very small.

When the lighting ratio threshold is 25%, for example, more than 75% of the display screen is displayed in black. Such case may happen when the image signal has text information displayed on a black background. In this case, luminance unevenness is not noticeable even in a bright area. Accordingly, in the second embodiment, the image signal compensation circuit does not compensate the signal in order to give priority to reduction in power consumption.

As described above, image signal compensation circuit 50 of this embodiment further has lighting ratio calculating circuit 62 which calculates a lighting ratio of the pixel for each of the frames in the image signal, and second comparison circuit 64 which compares the lighting ratio and a lighting ratio threshold (second threshold). The circuit 50 compensates the image signal when the image signal is larger than the first threshold and the lighting ratio is larger than the second threshold.

When displaying a dark image or a character in a black background, the compensation circuit does not perform compensation and reduces power consumption. The power consumption can be thereby reduced when those images are displayed. As a result, a high quality image without luminance unevenness can be displayed while a feature of the organic EL display, i.e. battery-operable for long hours, can be maintained.

As described above, the image signal compensation circuit determines whether the compensation should be performed or not based on the comparison of the lighting ratio of the image signal with the predetermined lighting ratio threshold. However, the lighting ratio of the image signal may change frequently around the lighting ratio threshold level. In such case, the frequent ON/OFF of the compensation switches may cause a flicker. This flicker can be avoided by giving a hysteresis to the lighting ratio threshold. That is, when the mode is switching from non-compensating to compensating, the threshold is set large (for example 35%). When the mode is switching from compensating to non-compensating, the threshold is set small (for example 25%).

Further, the low luminance threshold or the lighting ratio threshold can be set differently according to the light emitting efficiency or spectral luminous efficacy of each colored organic EL device (green, blue, or red). For example, low luminance threshold for red and blue devices can be set larger than the green devices because the luminance unevenness is hard to see in red and blue. The similar mechanism can be applied to the lighting ratio threshold.

In the first and second embodiments, each numerical value, e.g. voltage is an exemplary value, and these values may be set optimally according to the characteristics of organic EL device or the display apparatus.

INDUSTRIAL APPLICABILITY

The above disclosure is useful for a display apparatus which can reduce power consumption especially in dark screen and can display a high quality image free from luminance unevenness.

The invention claimed is:

1. A display apparatus comprising:

an image display unit having a plurality of arrayed pixel circuits; and an image signal compensation circuit coupled to the image display unit, wherein:

each of the pixel circuits includes:

a current light emitting device;

a driving transistor supplying a current to the current light emitting device; and a compensating capacitor which is disposed between a gate and a source of the driving transistor, and compensates a threshold voltage of the driving transistor, the image signal compensation circuit includes:

a compensation memory storing compensation data for compensating mobility dispersion among driving transistors of the plurality of arrayed pixel circuits, the compensation data being for all of the plurality of arrayed pixel, the compensation memory being configured by a frame memory;

a comparison circuit which compares an image signal with a threshold value of luminance; and an arithmetic circuit which outputs a compensated image signal being compensated by using the compensation data read from the compensation memory, the comparison circuit outputs an enabling signal to the compensation memory and the arithmetic circuit when the image signal has a luminance larger than the threshold value, the compensation data is output from the compensation memory to the arithmetic circuit according to the enabling signal, and the image signal compensation circuit outputs the compensated image signal to the image display unit when the image signal has the luminance larger than the threshold value, and outputs the image signal to the image display unit when the image signal has a luminance smaller than the threshold value.

2. The display apparatus of claim 1, wherein:

the compensation memory stores compensation data for compensating variation of current in the driving transistors, the image signal compensation circuit further comprises a lighting ratio calculation circuit calculating a lighting ratio of the plurality of arrayed pixel circuits for every frame of the image signal, the comparison circuit comprises:

a first comparison circuit comparing the image signal and a first threshold of luminance; and a second comparison circuit comparing the lighting ratio calculated by the lighting ratio calculation circuit and a second threshold which is different from the first threshold, wherein the image signal compensation circuit compensates the image signal when the image signal is larger than the first threshold and the lighting ratio is larger than the second threshold.

3. The display apparatus of claim 1, wherein:

each of the pixel circuits further comprises:

a first capacitor having a first terminal connected to a gate of the driving transistor;

a second capacitor connected between a second terminal of the first capacitor and a source of the driving transistor;

a first switch applying a reference voltage to a node to which the first and the second capacitors are connected;

a second switch supplying an image signal voltage to the gate of the driving transistor;

a third switch supplying an initialization voltage to drain of the driving transistor; and a fourth switch supplying current to the drain of the driving transistor for emitting light from the current light emitting device, and the second capacitor is the compensating capacitor.

4. The display apparatus of claim 1, wherein the comparison circuit further comprises a logic AND circuit for receiving output signals from the first comparison circuit and the second comparison circuit.

5. The display apparatus of claim 4, wherein:

the logic AND circuit outputs an enabling signal to the compensation memory and the arithmetic circuit, and the compensation data is output from the compensation memory to the arithmetic circuit according to the enabling signal.

6. The display apparatus of claim 1, wherein each of the compensation data for a given driving transistor is calculated from a ratio between a mobility of the given driving transistor and a mobility of a standard driving transistor.

* * * * *